US007987928B2

(12) United States Patent
Vuyk, Jr. et al.

(10) Patent No.: US 7,987,928 B2
(45) Date of Patent: Aug. 2, 2011

(54) INJECTION SYSTEM AND METHOD COMPRISING AN IMPACTOR MOTIVE DEVICE

(75) Inventors: Adrian Vuyk, Jr., Houston, TX (US); Greg Galloway, Conroe, TX (US); Jim Terry, Houston, TX (US); Gordon Tibbitts, Murray, UT (US); Kenneth Colvin, Spring, TX (US); Thomas Alan Carlson, Baytown, TX (US)

(73) Assignee: PDTI Holdings, LLC, Houston, TX (US)

( * ) Notice: Subject to any disclaimer, the term of this patent is extended or adjusted under 35 U.S.C. 154(b) by 324 days.

(21) Appl. No.: 12/248,649

(22) Filed: Oct. 9, 2008

(65) Prior Publication Data

US 2009/0090557 A1 Apr. 9, 2009

Related U.S. Application Data

(60) Provisional application No. 60/978,653, filed on Oct. 9, 2007.

(51) Int. Cl.
*E21B 21/01* (2006.01)

(52) U.S. Cl. ..... 175/67; 175/54; 175/206; 175/207; 166/75.15

(58) Field of Classification Search ..... 175/54, 175/206, 207, 67, 424
See application file for complete search history.

(56) References Cited

U.S. PATENT DOCUMENTS 2,626,779 A 1/1953 Armentrout
2,724,574 A 11/1955 Ledgerwood, Jr.
2,727,727 A 12/1955 Williams
2,728,557 A 12/1955 McNatt
2,761,651 A 9/1956 Ledgerwood, Jr.
2,771,141 A 11/1956 Lewis
2,779,571 A 1/1957 Ortloff
2,807,442 A 9/1957 Ledgervvood, Jr.
2,809,013 A 10/1957 Ledgerwood, Jr. et al.
2,815,931 A 12/1957 Williams
2,841,365 A 7/1958 Ramsey et al.
2,868,509 A 1/1959 Williams
2,954,122 A 9/1960 Colburn
3,001,652 A 9/1961 Schroeder et al.
3,055,442 A 9/1962 Prince (Continued)

FOREIGN PATENT DOCUMENTS

CA 2522568 A1 11/2004

(Continued)

OTHER PUBLICATIONS

Co-pending U.S. Appl. No. 12/363,022, filed Jan. 30, 2009, Tibbitts et al.

(Continued)

*Primary Examiner* — William P Neuder
*Assistant Examiner* — Nicole A Coy
(74) *Attorney, Agent, or Firm* — Vedder Price P.C.

(57) ABSTRACT

An excavation system for forming a wellbore through a subterranean formation, the system employing pressurized drilling fluid with impactors mixed therein. The pressurized fluid with impactors is directed to a drill string having a drill bit with nozzles on its lower end. The fluid impactor mixture is discharged from the nozzles and against the formation, wherein the impactors contact, compress, and fracture the formation to excavate through the formation. The system includes an impactor injection system that injects impactors into a stream of pressurized drilling fluid to form the mixture. The injection system operates at substantially the same pressure as the pressurized drilling fluid.

23 Claims, 3 Drawing Sheets

U.S. PATENT DOCUMENTS

| | | | |
|---|---|---|---|
| 3,084,752 | A | 4/1963 | Tiraspolsky |
| 3,093,420 | A | 6/1963 | Levene |
| 3,112,800 | A | 12/1963 | Bobo |
| 3,123,159 | A | 3/1964 | Buck |
| 3,132,852 | A | 5/1964 | Dolbear |
| 3,322,214 | A | 5/1967 | Buck |
| 3,374,341 | A | 3/1968 | Klotz |
| 3,380,475 | A | 4/1968 | Armstrong |
| 3,385,386 | A | 5/1968 | Goodwin et al. |
| 3,389,759 | A | 6/1968 | Mori et al. |
| 3,416,614 | A | 12/1968 | Goodwin et al. |
| 3,424,255 | A | 1/1969 | Mod et al. |
| 3,469,642 | A | 9/1969 | Goodwin et al. |
| 3,542,142 | A | 11/1970 | Hasiba et al. |
| 3,548,959 | A | 12/1970 | Hasiba et al. |
| 3,560,053 | A | 2/1971 | Ortloff |
| 3,576,221 | A | 4/1971 | Hasiba |
| 3,645,346 | A | 2/1972 | Miller et al. |
| 3,667,557 | A | 6/1972 | Todd et al. |
| 3,688,852 | A | 9/1972 | Gaylord et al. |
| 3,688,859 | A | 9/1972 | Maurer |
| 3,704,966 | A | 12/1972 | Beck, Jr. |
| 3,831,753 | A | 8/1974 | Gaylord et al. |
| 3,838,742 | A | 10/1974 | Juvkam-Wold |
| 3,852,200 | A | 12/1974 | Meyer |
| 3,865,202 | A | 2/1975 | Takahashi et al. |
| 3,924,698 | A | 12/1975 | Juvkam-Wold |
| 4,042,048 | A | 8/1977 | Schwabe |
| 4,067,617 | A | 1/1978 | Bunnelle |
| 4,141,592 | A | 2/1979 | Lavon |
| 4,266,621 | A | 5/1981 | Brock |
| 4,304,609 | A | 12/1981 | Morris |
| 4,361,193 | A | 11/1982 | Gravley |
| 4,391,339 | A | 7/1983 | Johnson, Jr. et al. |
| 4,444,277 | A | 4/1984 | Lewis |
| 4,476,027 | A | 10/1984 | Fox |
| 4,490,078 | A | 12/1984 | Armstrong |
| 4,492,276 | A | 1/1985 | Kamp |
| 4,497,598 | A | 2/1985 | Blanton |
| 4,498,987 | A | 2/1985 | Inaba |
| 4,534,427 | A | 8/1985 | Wang et al. |
| 4,624,327 | A | 11/1986 | Reichman |
| 4,627,502 | A | 12/1986 | Dismukes |
| 4,681,264 | A | 7/1987 | Johnson |
| 4,699,548 | A | 10/1987 | Bergstrom |
| 4,768,709 | A | 9/1988 | Yie |
| 4,809,791 | A | 3/1989 | Hayatdavoudi |
| 4,825,963 | A | 5/1989 | Ruhle |
| 4,852,668 | A | 8/1989 | Dickinson, III et al. |
| 5,199,512 | A | 4/1993 | Curlett |
| 5,291,957 | A | 3/1994 | Curlett |
| 5,355,967 | A | 10/1994 | Mueller et al. |
| 5,421,420 | A | 6/1995 | Malone et al. |
| 5,542,486 | A | 8/1996 | Curlett |
| 5,718,298 | A | 2/1998 | Rusnak |
| 5,799,734 | A | 9/1998 | Norman et al. |
| 5,862,871 | A | 1/1999 | Curlett |
| 5,881,830 | A | 3/1999 | Cooley |
| 5,897,062 | A | 4/1999 | Enomoto et al. |
| 5,944,123 | A | 8/1999 | Johnson |
| 6,003,623 | A | 12/1999 | Miess |
| 6,142,248 | A | 11/2000 | Thigpen et al. |
| 6,152,356 | A | 11/2000 | Minden |
| 6,216,801 | B1 | 4/2001 | Jonnes |
| 6,345,672 | B1 | 2/2002 | Dietzen |
| 6,347,675 | B1 | 2/2002 | Kolle |
| 6,386,300 | B1 | 5/2002 | Curlett et al. |
| 6,474,418 | B2 | 11/2002 | Miramon |
| 6,506,310 | B2 | 1/2003 | Kulbeth |
| 6,530,437 | B2 | 3/2003 | Maurer et al. |
| 6,533,946 | B2 | 3/2003 | Pullman |
| 6,571,700 | B2 | 6/2003 | Nakamura et al. |
| 6,581,700 | B2 | 6/2003 | Curlett et al. |
| 6,601,650 | B2 | 8/2003 | Sundararajan |
| 6,651,822 | B2 | 11/2003 | Alanis |
| 6,732,797 | B1 | 5/2004 | Watters et al. |
| 6,904,982 | B2 | 6/2005 | Judge et al. |
| 6,920,945 | B1 | 7/2005 | Belew et al. |
| 7,090,017 | B2 | 8/2006 | Justus et al. |
| 7,172,038 | B2 | 2/2007 | Terry et al. |
| 7,258,176 | B2 | 8/2007 | Tibbitts et al. |
| 7,343,987 | B2 | 3/2008 | Tibbitts |
| 7,383,896 | B2 | 6/2008 | Tibbitts |
| 7,398,838 | B2 | 7/2008 | Harder et al. |
| 7,398,839 | B2 | 7/2008 | Harder et al. |
| 7,503,407 | B2 | 3/2009 | Tibbitts |
| 7,757,786 | B2 | 7/2010 | Harder et al. |
| 7,793,741 | B2 | 9/2010 | Harder et al. |
| 7,798,429 | B1 | 9/2010 | Porter |
| 2002/0011338 | A1 | 1/2002 | Maurer et al. |
| 2002/0134550 | A1 | 9/2002 | Leeson et al. |
| 2006/0011386 | A1 | 1/2006 | Tibbitts |
| 2006/0016622 | A1 | 1/2006 | Tibbitts |
| 2006/0016624 | A1 | 1/2006 | Tibbitts |
| 2006/0021798 | A1 | 2/2006 | Tibbitts |
| 2006/0027398 | A1 | 2/2006 | Tibbitts |
| 2006/0124304 | A1 | 6/2006 | Bloess et al. |
| 2006/0180350 | A1 | 8/2006 | Harder |
| 2006/0191717 | A1 | 8/2006 | Harder et al. |
| 2006/0191718 | A1 | 8/2006 | Harder et al. |
| 2008/0017417 | A1 | 1/2008 | Tibbits |
| 2008/0135300 | A1 | 6/2008 | James |
| 2008/0156545 | A1 | 7/2008 | Tibbitts |
| 2008/0196944 | A1 | 8/2008 | Tibbitts |
| 2008/0210472 | A1 | 9/2008 | Tibbitts |
| 2008/0230275 | A1 | 9/2008 | Harder |
| 2009/0038856 | A1 | 2/2009 | Vuyk |
| 2009/0090557 | A1 | 4/2009 | Vuyk, Jr. et al. |
| 2009/0126994 | A1 | 5/2009 | Tibbitts et al. |
| 2009/0200080 | A1 | 8/2009 | Tibbitts |
| 2009/0200084 | A1 | 8/2009 | Vuyk |
| 2009/0205871 | A1 | 8/2009 | Tibbitts |
| 2009/0218098 | A1 | 9/2009 | Tibbitts et al. |
| 2009/0223718 | A1 | 9/2009 | Tibbitts |

FOREIGN PATENT DOCUMENTS

| | | | |
|---|---|---|---|
| CA | 2588170 | A1 | 5/2007 |
| EP | 0192016 | A1 | 8/1986 |
| GB | 2385346 | A | 8/2003 |
| GB | 2385346 | B | 9/2004 |
| IQ | 20055376 | | 11/2005 |
| WO | 0225053 | A1 | 3/2002 |
| WO | 0234653 | A | 5/2002 |
| WO | 02092956 | A | 11/2002 |
| WO | 2004094734 | A2 | 11/2004 |
| WO | 2004106693 | A2 | 12/2004 |
| WO | 2006001997 | A3 | 2/2006 |
| WO | 2009009792 | | 1/2009 |
| WO | 2009049076 | A1 | 4/2009 |
| WO | 2009065107 | A1 | 5/2009 |
| WO | 2009099945 | A2 | 8/2009 |

OTHER PUBLICATIONS

Co-pending U.S. Appl. No. 12/271,514, filed Nov. 14, 2008, Tibbitts et al.

Co-pending U.S. Appl. No. 11/773,355, filed Jul. 3, 2007, Vuyk Jr. et al.

Co-pending U.S. Appl. No. 12/120,763, filed May 15, 2008, Tibbitts.

Co-pending U.S. Appl. No. 11/204,862, filed Aug. 16, 2005, Tibbitts.

Co-pending U.S. Appl. No. 12/796,377, filed Jun. 6, 2010, Harder et al.

Co-pending U.S. Appl. No. 12/641,720, filed Dec. 18, 2009, Tibbitts et al.

Co-pending U.S. Appl. No. 12/752,897, filed Apr. 1, 2010, Tibbitts.

Co-pending U.S. Appl. No. 10/558,181, filed Jan. 22, 2008, Tibbitts.

Co-pending U.S. Appl. No. 11/801,268, filed May 9, 2007, Tibbitts et al.

Co-pending U.S. Appl. No. 12/033,829, filed Feb. 19, 2008, Tibbitts.

Co-pending U.S. Appl. No. 12/172,760, filed Jul. 14, 2008, Vuyk, Jr. et al.

Co-pending U.S. Appl. No. 12/388,289, filed Feb. 19, 2009, Tibbitts.

Behavior of Suspensions and Emulsion in Drilling Fluids, Nordic Rheology Society, Jun. 14-15, 2007.

Colby, RH., Viscoelasticity of Structured Fluids, Corporate Research Laboratories, Eastman Kodak Company, Rochester, New York.

Rheo-Plex Product Information Seet, Scomi, Oiltools, 2 pages.
Gelplex Product Information Sheet, Miswaco, 2 pages.
Drillplex Product Information Sheet, Miswaco, 2 pages.
Drillplex System Sucessfully Mills Casing Windows Offshore Egypt Performance Report, Miswaco, 2 pages.
Drillplex The Versatile Water-Base System With Exceptional Rheological Properties Designed to Lower Costs in a Wide Range of Wells Product Information Sheet, Miswaco, 6 pages.
International Search Report PCT/US05/25092; Dated Mar. 6, 2006.
Written Opinion PCT/US05/25092; Dated Mar. 6, 2006.
International Preliminary Report on Patentability dated Nov. 19, 2009 on PCT/US08/05955, 5 pages.
International Preliminary Report on Patentability on PCT/US2009/032654 dated Apr. 17, 2009, 6 pages.
International Search Report dated Dec. 30, 2009 on PCT/US2009/032654, 1 page.
File history of European Patent Application No. 04759869.3.
File history of European Patent Application No. 5771403.2.
File history of GCC Patent Application No. 2005/5376.
File history of Iraq Patent Application No. 98/2005.
File history of Norwegian Patent Application No. 20070997.
File history of Venezuelan Patent Application No. 1484-05.
File history of Canadian Patent Application No. 2,588,170.
File history of Canadian Patent Application No. 2,522,568.
File history of Iraq Patent Application No. 34/2004.
File history of Norwegian Patent Application No. 20055409.
File history of GCC Patent Application No. 2004/3659.
International Preliminary Report on Patentability dated Jan. 12, 2010 on PCT/US08/69972, 5 pages.
International Search Report dated Sep. 18, 2008 on PCT/US07/72794, 1 page.
International Preliminary Report on Patentability dated Oct. 9, 2008 on PCT/US08/69972, 5 pages.
*Curlett Family Limited Partnership, Ltd.,* Plaintiff v. *Particle Drilling Technologies, Inc.,* a Delaware Corporation; and Particle Drilling Technologies, Inc., a Nevada Corporation; Affidavit of Harry (Hal B. Curlett); May 3, 2006; 8 pages.
Geddes et al "Leveaging a New Energy Souce to Enhance Heavy-Oil and Oi-Sands Poducton," Society of Petroleum Engineers, SPE/PS-CIM/CHOA 97781, 2005 (7 pages).
www.particledrilling.com, May 4, 2006.
Anderson, Arthur, "Global E&P Trends" Jul. 1999, (2 pages).
Cohen et al, "High-Pressure Jet Kerf Drilling Shows Significant Potential to Increase ROP", SPE 96557, Oct. 2005, pp. 1-8.
Eckel, et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling", Journal of Petroleum Technology, Aug. 1981, pp. 1379-1388.
Galecki et al., "Steel Shot Entrained Ultra High Pressure Waterjet for Cutting and Drilling in Hard Rocks", pp. 371-388.
Killalea, Mike, High Pressure Drilling System Triples ROPS, Stymies Bit Wear, Drilling Technology, Mar.-Apr. 1989, pp. 10-12.
Kolle et al., "Laboratory and Field Testing of an Ultra-High-Pressure, Jet-Assisted Drilling System," SPE/IADC 22000, 1991, pp. 847-856.
Ledgerwood, L., "Efforts to Develop Improved Oilwell Drilling Methods," Petroleum Transactions, Aime, 1960, 61-74, vol. 219.
Maurer, William, "Advanced Drilling Techniques," Chapter 5, pp. 19-27, Petroleum Publishing Co., Tulsa, OK. 1980.
Maurer, William, "Impact Crater Formation in Rock," Journal of Applied Physics, Jul. 1960, pp. 1247-1252, vol. 31, No. 7.
Maurer et al., "Deep Drilling Basic Research vol. 1—Summary Report," Gas Research Institute, GRI 90/0265.1, Jun. 1990.
Peterson et al., "A New Look at Bit-Flushing or The Importance of the Crushed Zone in Rock Drilling and Cutting," (20 pages).
Ripken et al., "A Study of the Fragmentation of Rock by Impingement with Water and Solid Impactors," University of Minnesota St. Anthony Falls Hydraulic Laboratory, Feb. 1972, 114 pages.
Review of Mechanical Bit/Rock Interactions, vol. 3, pp. 3-1 to 3-68. Security DBS, 1995, (62 pages).
Singh, Madan, "Rock Breakage by Pellet Impact," IIT Research Institute, Dec. 24, 1969 (92 pages).
Summers et al., "A Further Investigation of DIAjet Cutting," Jet Cutting Technology-Proceedings of the 10th International Conference, 1991, pp. 181-192; Elsevier Science Publishers Ltd, USA.
Summers, David, "Waterjetting Technology," Abrasive Waterjet Drilling, pp. 557-598, Curators' Professor of Mining Engineering and Director High Pressure Waterjet Laboratory University of Missouri-Rolla Missouri, E & FN SPON, London, UK, First Edition 1995 (ISBN 0 419 19660 9).
Veenhuizen, et al., "Ultra-High Pressure Jet Assist of Mechanical Drilling," SPE/IADC 37579, pp. 79-90, 1997.
International Search Report PCT/US04/11578; dated Dec. 28, 2004 (4 pages).
International Preliminary Report of Patentability PCT/US04/11578; dated Oct. 21, 2005 (5 pages).
Written Opinion PCT/US04/11578; dated Dec. 28, 2004 (4 pages).
Examination Report dated May 8, 2007 on GCC Patent No. GCC/P/2004/3505 (4 pages).
Co-pending U.S. Appl. No. 12/033,829, filed Feb. 19, 2008, Titled "Impact Excavation System and Method With Particle Separation".
Co-pending U.S. Appl. No. 12/120,763, filed May 15, 2008, Titled "Impact Excavation System and Method With Particle Separation".
Co-pending U.S. Appl. No. 12/122,374, filed May 16, 2008, Titled "Impact Excavation System and Method With Injection System".

22
24
26a
28
29
30
32
42
43
44
46
47
48
50
51
52
54
56
58
60
62
64
65
66
68
72
73
74
76
78
80
82
88
90

INJECTION SYSTEM AND METHOD COMPRISING AN IMPACTOR MOTIVE DEVICE

CROSS-REFERENCE TO RELATED APPLICATIONS

This application claims priority to and claims the benefit of U.S. Provisional Application Ser. No. 60/978,653, fled Oct. 9, 2007, the full disclosure of which is hereby incorporated by reference herein. This application is related to U.S. provisional patent application Ser. No. 60/463,903, filed on Apr. 16, 2003; U.S. Pat. No. 6,386,300, issued on May 14, 2002, which was filed as application Ser. No. 09/665,586 on Sep. 19, 2000; U.S. Pat. No. 6,581,700, issued on Jun. 24, 2003, which was filed as application Ser. No. 10/097,038 on Mar. 12, 2002; pending application Ser. No. 11/204,981, filed on Aug. 16, 2005; pending application Ser. No. 11/204,436, filed on Aug. 16, 2005; pending application Ser. No. 11/204,862, filed on Aug. 16, 2005; pending application Ser. No. 11/205,006, filed on Aug. 16, 2005; pending application Ser. No. 11/204,772, filed on Aug. 16, 2005; pending application Ser. No. 11/204,442, filed on Aug. 16, 2005; pending application Ser. No. 10/825,338, filed on Apr. 15, 2004; pending application Ser. No. 10/558,181, filed on May 14, 2004; pending application Ser. No. 11/344,805, filed on Feb. 1, 2006; pending application Ser. No. 11/801,268, filed May 9, 2007; application No. 60/899,135, filed Feb. 2, 2007, pending application Ser. No. 11/773,355, filed Jul. 3, 2007 and application No. 60/959,207, filed Jul. 12, 2007, the disclosures of which are incorporated herein by reference in their entireties.

BACKGROUND OF THE INVENTION

1. Field of the Invention

The present disclosure relates to the field of oil and gas exploration and production. More specifically, the present disclosure concerns a system and method for subterranean excavation using impactors. Yet more specifically, the present disclosure is directed to a system method of injecting impactors into a flow stream to form an impactor laden fluid stream for use in excavating a subterranean wellbore.

2. Description of Related Art

Boreholes for producing hydrocarbons within a subterranean are generally formed by a drilling system employing a rotating bit on the lower end of a drill string. The drill string is rotated by machinery on the Earth's surface. Drilling fluid is typically injected through the drill string that then exits the drill bit and travels back to the surface in the annulus between the drill string and wellbore inner circumference. The drilling fluid maintains downhole pressure in the wellbore to prevent hydrocarbons from migrating out of the formation and also washes away cuttings and other detritus resulting during drilling. The drilling bits are usually one of a roller cone bit or a fixed drag bit.

As described in the above referenced related applications, which are assigned to the assignee of the present application, impactors have recently been developed for use in subterranean excavations. Conventionally impactors are injected into a pressurized circulation fluid to form a combination. The combination is then directed to a drill string, having a bit on its lower end, and discharged through nozzles on the bit to structurally alter the subterranean formation. Because the impactors can damage the currently known means for pressurizing the circulation fluid, other methods are currently required for equalizing the pressure between the impactors and the circulation fluid for impactor injection.

DETAILED DESCRIPTION OF THE INVENTION

Figure 1:
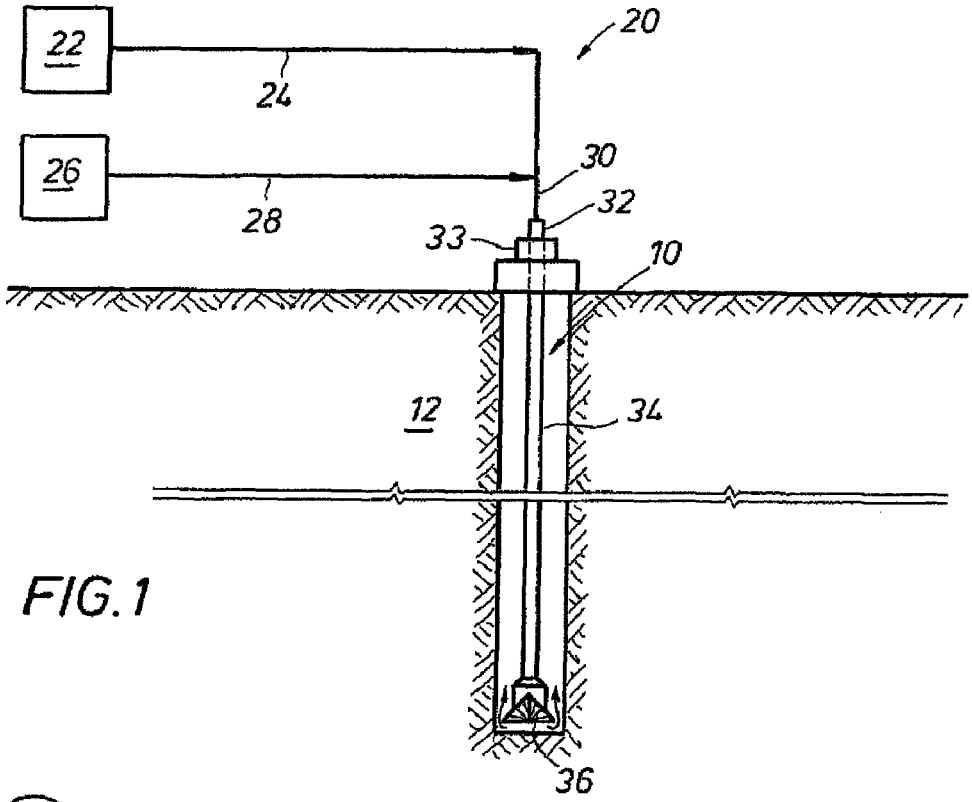
FIG. 1 is a side sectional view of a schematic embodiment of an impactor injector section in accordance with the present disclosure.

In the drawings and description that follows, like parts are marked throughout the specification and drawings with the same reference numerals, respectively. The drawings are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

FIG. 1 illustrates a schematic embodiment of an impactor excavation system 20 using solid material particles, or impactors, 50 to engage and excavate a subterranean formation 12 for creating a wellbore 10. The impactor excavation system 20 includes a drilling fluid source with a discharge that communicates with a drilling fluid line. An impactor delivery system includes an impactor feed that transports impactors to an impactor conveyer. The impactor conveyer, which is at a pressure substantially equal to the drilling fluid line, can act as an impactor motive device that moves or supplies impactors to the drilling fluid line. In the example of FIG. 1, a drilling fluid source is illustrated as drilling fluid pumps 22 shown discharging into a drilling fluid line 24. An impactor supply 26 and impactor supply line 28 form at least part of an impactor delivery system, shown in FIG. 1 the impactor supply 26 and impactor supply line 28 discharge into the drilling fluid line 24. The drilling fluid line 24 and impactor supply line 28 merge into an impactor/drilling fluid mixture line 30. The impactor fluid mixture line 30 will typically include a mixture of circulation drilling fluid having impactors therein. The drilling fluid mixture line 30 is shown connecting into an injection port 32 that communicates with the annulus of a drill string 34. The drill string 34 is shown extending into the wellbore 10 and having a drill bit 36 on its lower terminal end.

The arrows from the drill bit 36 bottom represent the impactor drilling fluid mixture after exiting from nozzles (not shown) on the drill bit 36 lower end. The drill bit 34 may be rotated during drilling by a top drive 33 shown above the wellbore 10 and having the injection port 32 formed thereon. Optionally, the drill bit 34 may be rotated by a rotary table.

The drill bit 36 may be a roller cone bit, a fixed cutter bit, an impact bit, a spade bit, a mill, an impregnated bit, a natural diamond bit, a drill bit as described in U.S. Pat. No. 7,258,176, or other suitable implement for cutting rock or earthen formation. In another exemplary embodiment, the present system may be used to inject any solid particulate material into a wellbore. Exemplary particles may be magnetic or non-magnetic solid particles. Exemplary uses of the of the present system include, but are not limited to, casing exits, chemical injection such as for formation treatment, preventing seepage loss, and fracturing a formation. The excavation system 20 is not limited to excavating a wellbore 10, but can also excavate a tunnel, a pipe chase, a mining operation, or be used in conducting other excavation operations wherein earthen material or formation may be removed.

Each of the individual impactors 50 is structurally independent from the other impactors. For brevity, the plurality of solid material impactors 50 may be interchangeably referred to as simply the impactors 50. The plurality of solid material impactors 50 may be substantially rounded and have either a substantially non-uniform outer diameter or a substantially uniform outer diameter. The solid material impactors 50 may be substantially spherically shaped, non-hollow, formed of rigid metallic material, and having high compressive strength and crush resistance, such as steel shot, ceramics, depleted uranium, and multiple component materials. Although the solid material impactors 50 may be substantially a non-hollow sphere, alternative embodiments may provide for other types of solid material impactors, which may include impactors 50 with a hollow interior. The impactors 50 may be magnetic or non-magnetic. The impactors 50 may be substantially rigid and may possess relatively high compressive strength and resistance to crushing or deformation as compared to physical properties or rock properties of a particular formation or group of formations being penetrated by the wellbore 10.

The impactors 50 may be of a substantially uniform mass, grading, or size. The solid material impactors 50 may have any suitable density for use in the excavation system 20. For example, the solid material impactors 50 may have an average density of at least 470 pounds per cubic foot. Alternatively, the solid material impactors 50 may include other metallic materials, including tungsten carbide, copper, iron, or various combinations or alloys of these and other metallic compounds. The impactors 50 may also be composed of non-metallic materials, such as ceramics, or other man-made or substantially naturally occurring non-metallic materials. Also, the impactors 50 may be crystalline shaped, angular shaped, sub-angular shaped, selectively shaped, such as like a torpedo, dart, rectangular, or otherwise generally non-spherically shaped.

The impactors 50 for a given velocity and mass of a substantial portion by weight of the impactors 50 are subject to the following mass-velocity relationship. The resulting kinetic energy of at least one impactor 50 exiting a nozzle is at least 0.075 Ft.Lbs or has a minimum momentum of 0.0003 Lbf.Sec. Kinetic energy is quantified by the relationship of an object's mass and its velocity. The quantity of kinetic energy associated with an object is calculated by multiplying its mass times its velocity squared. To reach a minimum value of kinetic energy in the mass-velocity relationship as defined, small particles such as those found in abrasives and grits, must have a significantly high velocity due to the small mass of the particle. A large particle, however, needs only moderate velocity to reach an equivalent kinetic energy of the small particle because its mass may be several orders of magnitude larger. In addition to the impactors 50 satisfying the mass-velocity relationship described above, a substantial portion by weight of the solid material impactors 50 have an average mean diameter of between approximately 0.050 to 0.500 of an inch.

To excavate a formation 12 minimum, in-situ stress levels or toughness of the formation 12 must be overcome. These minimum stress levels are known to typically range from a few thousand pounds per square inch, to in excess of 65,000 pounds per square inch. To fracture, cut, or plastically deform a portion of formation 12, typically should exceed the minimum, in-situ formation stress threshold. When an impactor 50 first initiates contact with the formation 12, the unit stress exerted upon the initial contact point may be much higher than 10,000 pounds per square inch, and may be well in excess of one million pounds per square inch. The stress applied to the formation 12 during contact is governed by the force the impactor 50 contacts the formation 12 with and the area of contact therebetween. The unit stress in the portion of the formation 12 contacted by an impactor 50 can reach values many times in excess of the in situ failure stress of the rock, thus guaranteeing fracture initiation and propagation and structurally altering the formation 12.

A substantial portion by weight of the solid material impactors 50 may apply at least 5000 pounds per square inch of unit stress to a formation 12 to create a structurally altered zone in the formation 12. The structurally altered zone is not limited to any specific shape or size, including depth or width. A substantial portion by weight of the impactors 50 may engage the formation 12 with sufficient energy to enhance creation of a wellbore 10 through the formation 12 by any or a combination of different impact mechanisms. An impactor 50 may directly remove a larger portion of the formation 12 than may be removed by abrasive-type particles. An impactor 50 may also penetrate into the formation 12 without removing formation material from the formation 12. A plurality of such formation penetrations, such as near and along an outer perimeter of the wellbore 10 may relieve a portion of the stresses on a portion of formation being excavated, which may thereby enhance the excavation action of other impactors 50 or the drill bit 36.

An impactor 50 may optionally alter one or more physical properties of the formation 12. Such physical alterations may include creation of micro-fractures and increased brittleness in a portion of the formation 12, which may thereby enhance effectiveness the impactors 50 in excavating the formation 12. The constant scouring of the bottom of the wellbore 10 also prevents the build up of dynamic filtercake, which can significantly increase the apparent toughness of the formation 12. A portion of the formation 12 ahead of the impactor 50 substantially in the direction of impactor travel may be altered such as by micro-fracturing and/or thermal alteration due to the impact energy. In such occurrence, the structurally altered zone Z may include an altered zone depth. An example of a structurally altered zone is a compressive zone, which may be a zone in the formation 12 compressed by the impactor 50.

Figure 2:
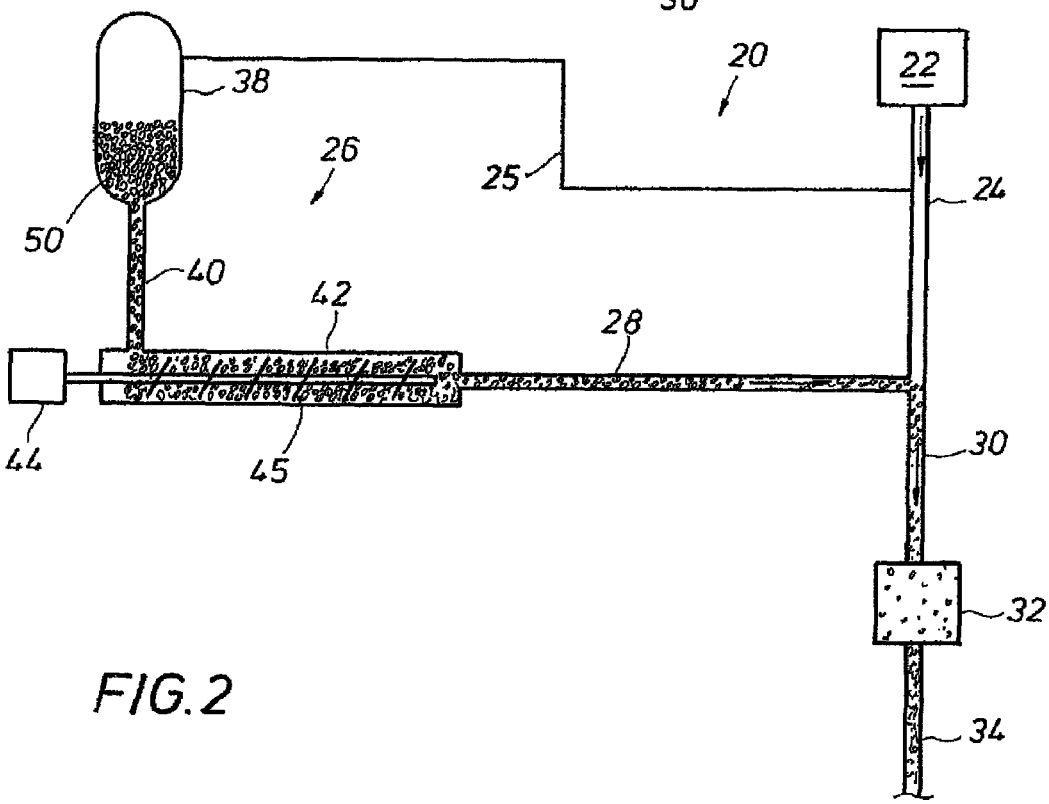
FIG. 2. is a schematical view of an impactor injection system as described herein.
Figure 3:
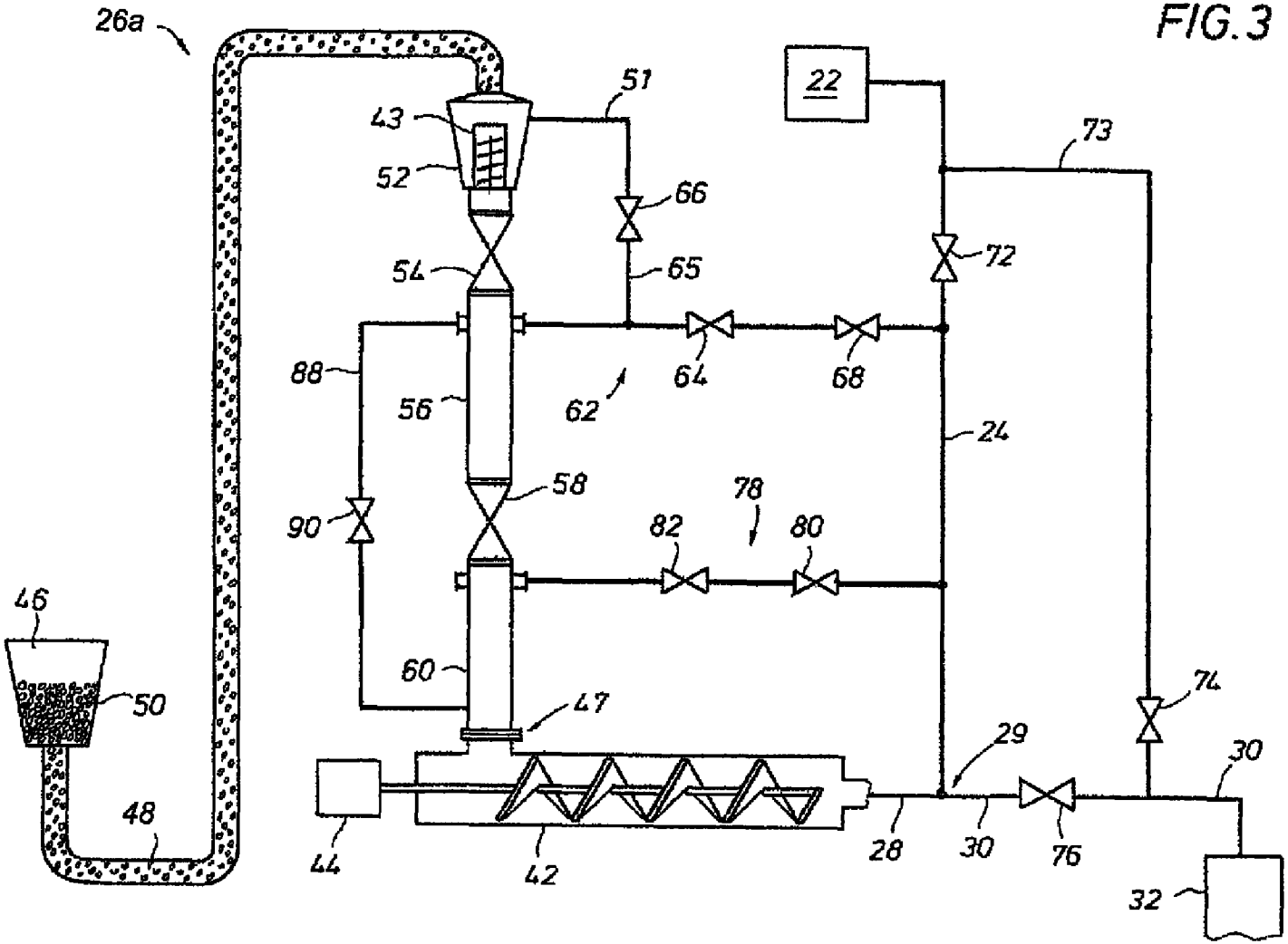
FIG. 3 is an alternative embodiment of a schematical view of an impactor injection system as described herein.

With reference now to FIG. 2, a schematical view is provided of an embodiment of an impactor supply system 26 discharging impactors 50 into a drilling fluid line. In this embodiment, the impactor supply system 26 includes a vessel 38 having impactors 50 therein. A feed line 40 coupled to the vessel 38 discharge carries impactors 50 from the vessel 38 to an impactor conveyer. The impactor conveyer may include a screw type device for moving the impactors into the drilling fluid line 24, examples include an auger, an extruder, a screw pump and the like. The conveyer may also include a pump, such as a centrifugal pump as well as a positive displacement pump.

A fluid, such as a drilling fluid, may be added to the impactors 50 within the vessel 38, or prior to inserting the impactors within the vessel 38, to lubricate and otherwise facilitate movement of the impactors 50 throughout the system. The impactor conveyor receives the impactors from the feed line 40 and urges them into the drilling fluid line 24 to form a mixture of impactors and drilling fluid 30. In the embodiment of FIG. 2, the impactor conveyor is an extruder 42 equipped with an elongated auger screw 45 having a helically shaped blade wrapped around a shaft. The system 26 includes a motor 44 shown attached to an end of the auger 42, the motor rotates the auger screw 45 to urge the impactors 50 from within the auger 42 to the impactor supply line 28 and into the inner section with the drilling fluid line. An optional equalizing line 25 connects the vessel 38 and the drilling fluid line 24.

As is known, the drilling fluid pumps 22 discharge pressurized fluid at pressures that typically exceed at least about 1,500 pounds per square inch and in some situations can exceed almost 5,000 pounds per square inch. In this embodiment of the impactor excavation system 20, the impactor supply system 26 is in pressure communication with the drilling fluid line 24. Because the impactor supply system 26 is in pressure communication with the drilling fluid line 24, injecting impactors 50 into the drilling fluid line 24 does not require the impactor supply system 26 to overcome a significant pressure differential. The pressure communication between the drilling fluid line 24 and impactor supply system 26 can be from direct fluid flow, such as the equalizing line 25 or the impactor supply line 28 where it intersects with the drilling fluid line 24. Optionally, the pressure communication can be across a flexible member such as a diaphragm, or from a piston arrangement. As discussed above, mixing the impactors 50 with the drilling fluid forms the impactor drilling fluid mixture which is directed through the mixture line 30 to an injection port 32 and onto the drilling string 34 annulus for excavating a wellbore.

An alternative embodiment of an impactor supply system **26*a* is shown in a schematic view. Also illustrated is an embodiment of the drilling fluid line 24 and associated drilling fluid pumps 22. As shown, the impactor supply system 26*a* contains an impactor storage bin 46 having impactors 50 contained therein. The impactor storage bin 46 can be a container permanently set in a foundation, or optionally temporarily affixed and movable from one location to another. The storage bin 46** can be at grade or at some elevation above grade within a structure.

The impactor transfer line 48 is shown having impactors 50 being transported therein from the storage bin 46 to a hopper 52. The transfer line 48 can be a gravity feed line, or in situations when the hopper 52 is elevated above the storage bin 46, the impactor transfer line 48 may include an elevator means for raising the impactors 50 for transfer and discharge into the hopper 52. Coupled to the lower portion of the hopper 52 is an upper gate valve 54. The gate valve 54 is selectively opened to allow the passage of impactors 50 from the hopper 52 discharge and through the gate valve 54. The gate valve 54, which is also selectively closeable, is sealable against high pressures, such as a pressure differential between the drilling fluid pump 22 discharge and ambient pressure. An upper end of an elongated tubular-shaped upper chamber 56 is shown coupled to the lower end of the upper gate valve 54. A selectively openable and closeable lower gate valve 58 is connected on the upper chamber 56 lower end. A tubular lower chamber 60 is affixed on its upper end to the lower gate valve 58 lower end. The lower chamber 60 connects to the auger inlet 47 on its lower end. The auger 42 discharge connects to the impactor supply line 28, the impactor supply line 28 connects to the drilling fluid line 24 at an intersection 29. The impactor/drilling fluid mixture line 30 initiates at the intersection 29. An optional feed auger 43 is shown vertically disposed within the hopper 52, and as will be explained in further detail below, can increase the flow rate of impactors 50 from the hopper 52 to and through the upper gate valve 54.

The system **26*a* also includes optional vent and/or pressure equalizing lines to further enhance impactor 50 movement through the system 26*a*. For example, an equalizing vent line 88 attaches on its upper end to the upper chamber 56 and on its lower end to the lower chamber 60. A vent line valve 90 is disposed in the equalizing vent line 88** and may be selectively opened and/or closed. Examples of suitable valves include a gate, block, ball, check, or other device for selectively allowing flow therethrough.

An upper equalizing line 62 is included that has a first end connected with the drilling fluid line 24 downstream of a first plug valve 72. The upper equalizing line 62 second end is connected to the upper chamber 56. A selectively openable and closeable valve 68 is provided in the upper equalizing line 62. The upper equalizing line 62 may include an upper equalizing line check valve 64 between the upper chamber 56 and the valve 68. The upper equalizing line check valve 64 is configured to allow fluid flow towards the upper chamber 56 and from the drilling fluid line 24, while preventing flow from the upper chamber 56.

An upper bleed line 65 connects on its lower end to the upper equalizing line 62 between the check valve 64 and upper chamber 56. Optionally, the upper bleed line 65 can connect on its lower end directly to the upper chamber 56. The upper bleed line 65 terminates into a manifold 51 that is shown connected to the hopper 52. An upper bleed valve 66 is provided within the upper bleed line 65. A lower bleed line 78 extends between the drilling fluid line 24 and the lower chamber 60. The lower bleed line 78 connects to the drilling fluid line 24 proximate to where the upper equalizing line intersects with the drilling fluid line 24. Similar to the upper equalizing line 62, the lower equalizing line 78 may include a valve 80, and/or a check valve 82.

An optional bypass line 73 connects the drilling fluid line 24 and the impactor/drilling fluid mixture line 30. The bypass line 73 connects on the drilling fluid line 24 upstream of the first plug valve 72 and to the fluid mixture line 30 between the injector port 32 and a third plug valve 76. A third plug valve 76 is shown in the fluid mixture line 30 downstream of the intersection between the impactor supply line 28 and drilling fluid line 24. A selectively opened and closed second plug valve 74 is shown provided in the bypass line 73.

In one example of use of the system described herein, the drilling fluid circuit is initiated before impactors are delivered from the supply and into the injection system. For example, drilling fluid pumps 22 may be activated to pressurize drilling or circulation fluid that is discharged from the pumps 22. In this example of startup, the drilling fluid is bypassed from the impactor portion of the circuit through bypass line 73. Thus, the first plug valve 72 and the third plug valve 76 are in the closed position and the second plug valve 74 is open thereby allowing pressurized drilling fluid to pass from the pumps 22 through the bypass line 73 into the mixture line 30 and through the injection port 32.

The impactors 50 may be introduced into the impactor supply system 26*a* by first transferring impactors 50 from the impactor storage bin 46 through the impactor transfer line 48 and into the impactor hopper 52. A quantity of impactors 50 may then be discharged from the hopper 52 while the upper gate valve 54 and the lower gate valve 58 are both in an open position thereby dispensing a controlled volume of impactors 50 into both the upper chamber 56 and lower chamber 60. Once the chambers 56, 60 have received impactors 50 therein, the upper gate valve 54 can be sealed shut thereby isolating the chambers from the hopper 52. With the chambers 56, 60 loaded with impactors 50, they can be pressurized up to about the pressure in the drilling fluid line 24. Pressure communication between the upper chamber 56 and the drilling fluid line 24 can occur by selectively opening the valve 68 and allowing fluid to flow through the upper equalizing line 62 thereby pressure communicating the drilling fluid line 24 and upper chamber 56. Similarly, the lower chamber 60 can be similarly pressure equalized by selectively opening the lower equalizing valve 80 and communicating the drilling fluid line 24 pressure to the lower chamber 60. Optionally, the valve 80 may remain open during the entire cycle since the pressure in the lower chamber 60 is substantially equal to the pressure in line 24.

Impactors 50 delivered to the lower chamber 60 fall through its bottom end to the auger inlet 47 and into the auger 42. Activating the auger 42 thereby conveys the impactors 50 received within the auger 42 from the lower chamber 60 through the impactor discharge and to the impactor supply line 28. Due to the above described pressure equalization, impactors 50 being urged from the auger 42 towards the intersection 29 are pressurized to about the drilling fluid line 24 pressure. Thus the impactors 50 are not subject to a pressure differential hindering their flow through the supply line 28. As such, the impactor injection system described herein can be designed for overcoming impactor inertia and dynamic line losses between the injector and the intersection 29 and does not require independently pressurizing the impactors to a pressure required for injection into the drilling fluid line 24. Continued urging of the impactors 50 with the auger 42, combined with the supply of high pressure drilling fluid from the drilling pumps 22, provides a means for flowing the mixture of drilling fluid and impactors 50 through the mixture line 30 and into the injection port 32 for wellbore excavation.

The portion of the impactor supply system 26*a* from the impactor storage bin 46 up to the upper gate valve 54 inlet is at a pressure lower than the drilling fluid line 24. Typically, this pressure will likely be at about ambient pressure but can be higher. To allow refilling the chambers 56, 60 during system 26*a* operation, the upper chamber 56 pressure is cycled between drilling fluid line 24 pressure and the lower impactor supply system 26*a* pressure (or feed pressure). For example, the level of impactors 50 within one of the upper or lower chambers 56, 60 will fall with continued urging of the impactors 50 through the auger 42 discharge. Ultimately, all impactors 50 in the upper chamber 56 will migrate downward into the lower chamber 60 and the impactor 50 level will be within the lower chamber 60.

To prevent exhausting the supply of impactors 50, additional batches of impactors 50 are added to the upper chamber 56 after the chamber 56 has been fluidically isolated and depressurized. Thus the hopper 52 and optionally the feed auger 43 can operate as a batch feed for feeding batches of impactors 50 to the upper chamber 56, which can operate as a batch feed section. For example, after the impactor 50 level has dropped at a point below the lower gate valve 58 lower end, the lower gate valve 58 is selectively sealed closed to pressure isolate the upper chamber 56 from the lower chamber 60. Additionally, the upper equalizing line valve 68 is also sealed shut pressure isolating the upper chamber 56 from the drilling fluid line 24. The upper bleed valve 66 can then be opened to vent pressure from within the upper chamber 56 through the upper bleed line 65 into the hopper 52. This reduces the pressure within the upper chamber 56 to about the hopper 52 pressure. Equalizing the pressure in the upper chamber 56 and the hopper 52 establishes a feed pressure in the upper chamber 56 that enhances impactor 50 feed to the upper chamber 56.

After venting the upper chamber 56, the upper gate valve 54 can be reopened to allow an additional batch volume of impactors 50 to fall from the bin 52 and populate the upper chamber 56. The optional auger 43 may be activated to increase the rate of flow of impactors 50 into the upper chamber 56. After sealingly closing the upper bleed valve 66, the upper chamber 56 can be repressurized at substantially the drilling fluid pressure by opening the upper equalizing valve 68 thereby communicating pressure between the drilling fluid line 24 and the upper chamber 56 through the upper equalizing line 62. Reopening the lower gate valve 58 allows additional impactors 50 to then fall into the lower chamber 60, roughly equal to the drilling fluid pressure, and for ultimate delivery to the auger 42. For the purposes of discussion herein, a substantially equal pressure can mean two different locations, which are otherwise in pressure and/or fluid communication, have the same pressure although a measurable pressure differential exists between the two locations due to a dynamic line loss or static head loss.

Optionally, the vent line valve 90 can be selectively opened while the impactors 50 within the upper chamber 56 are dropped into the lower chamber 60 through the gate valve 58. An open vent line valve 90 makes an available transfer path for a fluid volume from the lower chamber 60 through the equalizing vent line 88 and into the volume of space within the upper chamber 56 left vacant by the falling impactors 50. Bypassing the lower gate valve 58 with replacement fluid avoids the "coke bottle effect" caused when downward fluid flow is restricted by upward replacement fluid flow.

After the level of impactors 50 has once again fallen below the lower gate valve 58, the above-mentioned steps of sealing, venting, populating, and repressurizing may be repeated to maintain a continuous flow of impactors 50 to the auger 42. Therefore, a series of batch processes of feeding impactors through the upper chamber 56 can be employed to simulate a continuous process of impactor 50 delivery into the wellbore 10.

Figure 4:
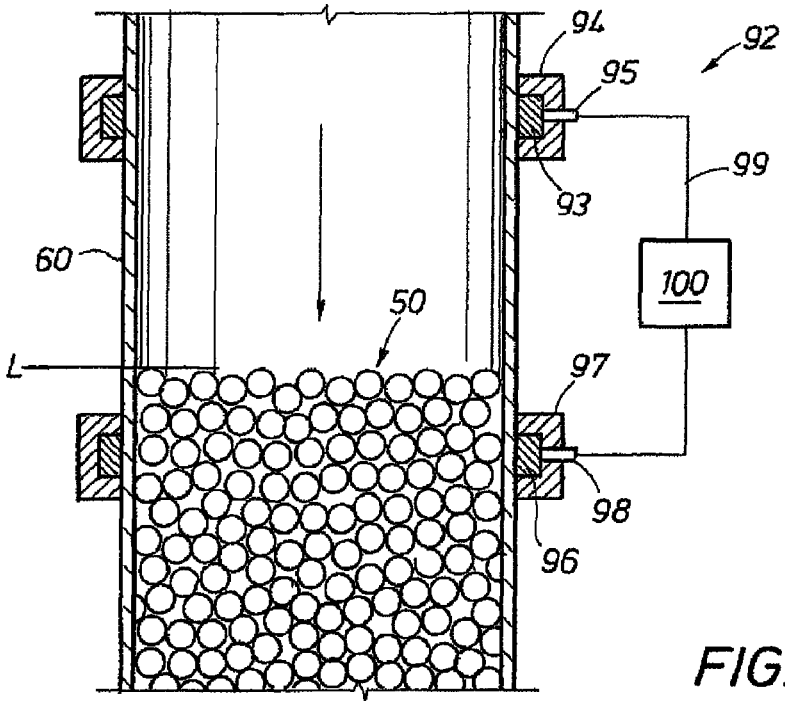
FIG. 4 is a side partial sectional view of a sensor in accordance with the present disclosure.

Monitoring the level of impactors 50 within the lower chamber 60 can be accomplished with a level sensor 92 illustrated affixed on an outer surface of the lower chamber 60. A partial sectional view of an example of a level sensor 92 is illustrated in FIG. 4. In this embodiment the level sensor 92 has upper and lower conductors, insulators, and probes. More specifically, the sensor 92 includes an upper conductor 93 shown circumscribing the outer surface of the lower chamber 60. Surrounding the upper conductor 93 is an upper insulator 94 providing an insulating cover around the upper conductor. Also included is an upper probe 95 that extends through the upper insulator 94 and into the upper conductor 93. Below the upper conductor 93 is a corresponding lower conductor 96 with a similar lower insulator 97, and lower probe 98. The probes 95, 98 are shown connected via a wire 99 to a meter 100, the wire provides data communication from the probes 95, 98 to the meter 100.

In one example of use, the meter 100 is an ohmmeter that compares the relative resistances measured by each of the probes 95, 98. Accordingly, monitoring of the meter 100 can provide an indication when the level L of the impactors 50 is between the corresponding upper and lower conductors 93, 96. Thus, appropriate placement of the sensor 92 can provide a level indication of impactors 50 so that additional batch additions of impactors 50 can be added into the system 26*a*.

An embodiment of the injector system 26*a* exists where the auger 42 is about 4.5 feet and the motor 44 is rated at about 50 horse power, The lower chamber 60, lower gate valve 58, and upper chamber 56 are stacked on top of the auger 42 at the auger inlet 47. The lower and upper chambers 60, 56 each are formed from 6" extra heavy piping having a 5 inch inner diameter and a 6⅝ inch outer diameter. The lower chamber 60 capacity is about 20 gallons and the upper chamber 56 capacity is about 18 gallons. The hopper 52 is perched atop the upper chamber 56 optionally having a 30 gallon capacity. The injector system 26*a* may be installed in a tower having a height of about 53 feet, a width of about 8½ feet and depth of about 11 feet.

In alternate embodiments, the feed to the extruder 42 may include multiple stacked upper and/or lower chambers, wherein the number of impactor columns is limited only by the overall height of the system. Alternatively, in other embodiments, the feed to the extruder may be fed by multiple parallel substantially vertical upper and/or lower chambers.

Extruders for use in the above described system can be modified to use of one or more magnets about the barrel of the extruder. The extruder with magnets positioned about the barrel is particularly useful for use with magnetic particles, although it is understood that the present system is equally adept at handling non-magnetic materials, such as for example, materials useful for fracturing a wellbore.

EXAMPLE 1

In one non-limiting example of use, the injection system described extruded impactors 50 having a diameter of approximately 0.078 inches at a pressure of 5000 psi and a rate of between 5.8 and 15.5 gpm (gallons of impactors per minute) into a fluid stream having a flow rate of greater than 400 gpm. The test was performed six times with impactor extrusion rates of 14.3, 15.5, 10.6, 5.8, 7.2 and 9.1 gpm, as controlled by motor input settings, all at pressures of approximately 5000 psi. This system was tested without the feed auger 43 but preliminary testing indicates that the revised design with the feed auger is capable of 22 gallons of impactors per minute.

EXAMPLE 2

In another non-limiting example of use, during a controlled test an embodiment of the injection system conveyed impactors at a rate of at least 2.3 gpm and up to 15 gpm at pressures ranging from 1200 to 5000 psi.

The sensor 92 may be purchased from a variety of manufacturers and used according to the manufacturer's specifications or modified for use with the impactor systems described herein. Exemplary sensors include Omega's Continuous RF Capacitance Sensor, American Magnetics' Liquid Level Sensors, Ronan Engineering's Integral Electronics Point Detector, Siemens' capacitance level transmitters (such as for example, models SITRANS LC 300 or SITRANS LC 500), or the like.

While the present system has been described as a batch process, whereby separate and discrete volumes of the solid impactors are supplied to the impactor feed line, it is understood that the present system can also operate as a continuous process wherein impactors are constantly fed to the impactor feed line.

Means for increasing the packing of the column include the use of vibratory devices which may be attached to the external surfaces of the pipes. Optionally, the vibratory devices may be used throughout the system to prevent the impactors from stagnating or bridging within the pipes. Optionally, the systems described above may include one or more chambers in the impactor column, one or more valves and/or one or more extruders.

In another embodiment, the impactor injection system may include a fluid source, an extruder and a single chambered impactor source.

Figure 5:
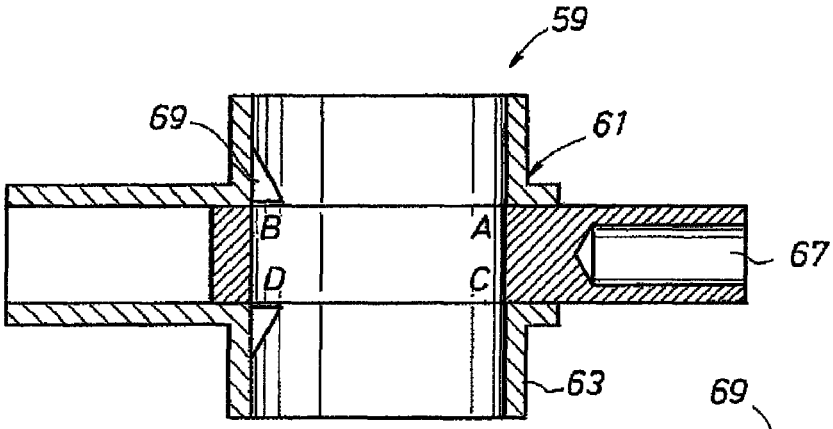
FIG. 5 illustrates a schematic view of a valve having a wiper attachment.

In another aspect, a gate valve 59 is provided for use with particulate materials, as shown for example in FIG. 5. The valve 59 includes annular upper and lower skirts 61, 63 gate 67 positioned between the skirts 61, 63. The skirts 61, 63 each include an opening transverse to the gate 67. The gate 67 has a bore provided therethrough shown in FIG. 5 aligned with the openings of the skirts 61, 63, this configuration defines a valve 59 open position. The gate 67 is selectively moveable within the valve 59 into a closed position when the solid portion of the gate 67 is between the openings in the skirts 61, 63. Thus the open position allows fluids and impactors 50 to flow through the valve 59 and the closed position prevents fluid and impactor 50 flow through the valve 59. In certain embodiments, such as for example, high pressure applications or during the use of particulate materials, the upper and lower surfaces of the gate 67 are flush with the upper and lower skirt 61, 63.

In certain embodiments, the gate valve 59 may include a wiper attachment 69, one embodiment of which is shown in FIG. 5, which may be secured to the side of one of the upper or lower skirt 61, 63 and is designed to direct the flow of particulate materials away from the leading edge of the moving portion of the gate valve 59. In certain embodiments, the wiper attachment 69 may be secured to the interior wall of the upper skirt 61, adjacent to the leading edge of the gate 67. The wiper attachment 69 may be secured by any known means, such as for example an adhesive, welded to the side of the wall, bolted to the side of the wall, or the like.

In certain embodiments, the wiper attachment 69 is designed to remain attached to the side wall while solid impactors 50 are supplied to the system 26 at high pressure. As shown in FIG. 5, in certain exemplary embodiments, the wiper attachment 69 may include an angled face which directs materials away from the edge of the gate 67 and toward the center of the fluid passage. Additionally, the wiper attachment 69 may be manufactured entirely of an elastomer or a like material, or may include a rubber insert located on the bottom of the wiper attachment 69, to prevent any of the solid particles from becoming lodged between the gate 67 and skirt 61, 63 during operation of the gate valve 59. While the wiper attachment shown in FIG. 5 is shown to be positioned on or near the leading edge of the gate 67, it is understood that the wiper attachment 69 may be positioned about the any portion or the entire interior circumference of the valve 59.

Figure 6:
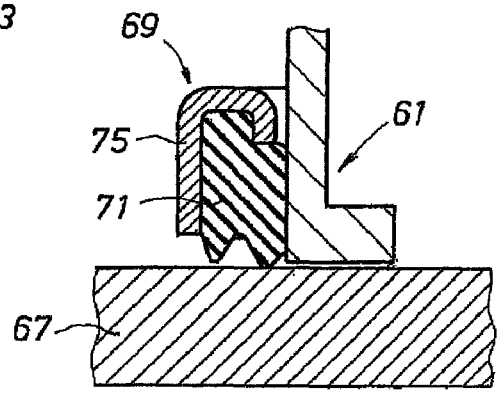
FIG. 6 depicts in side sectional view an embodiment of the valve of FIG. 5.

As shown in FIG. 6, in another exemplary embodiment, the wiper attachment may be positioned in a recess in one of the skirt 61, 63, thereby allowing a flush fit. The recess may be located adjacent to the gate 67. The wiper attachment 69 may include a metal ring 75 coupled to a wiper 71 blade. The wiper blade 71 bottom may include ridges which contact or nearly contact the upper surface of the gate. The wiper ridges or edges assist in sweeping away the impactors and other solids from the moving surfaces of the gate 67. Optionally, both skirts 61, 63 or the gate 67, may include wiper attachments 69. While the wiper blade 71 shown in FIG. 63 is a double lip wiper, it is understood that the wiper blade 71 may include one or more lips.

In certain embodiments, the gate 67 and skirts 61, 63 may include honed or sharpened leading edges, corresponding, for example, to the edges labeled as B and D on FIG. 5. In certain embodiments, the edges of the gate 67 and the skirts 61, 63 are sharpened to allow the leading edge of the gate 67 to shear the solid materials, such as for example, solid impactors 50.

In certain embodiments, one or more of the surfaces of the gate valve 59, including the interior walls of the upper and lower skirt 61, 63, the surfaces of the upper and lower skirts 61, 63 which contact the gate 67, and the surfaces of the gate 67, may include a surface treatment or hardfacing to increase wear and abrasion resistance of the gate valve. In certain other embodiments, all interior surfaces of the valve 59 may receive the surface treatment. In certain embodiments, only the surfaces which contact or rub other metal surfaces may include the surface treatment. Exemplary alloys useful in the hardfacing of the surfaces of the gate valve include, but are not limited to, tungsten carbide alloys, nickel-chromium-tungsten alloys, diamond, ceramics; tool steels containing one or more of: iron, carbon, sulfur, phosphorus, vanadium, manganese, chromium, molybdenum, or silicon; flame sprayed or atomized powder applications containing one or more of: chrome, boron, silicon, silicates, molybdenum, iron, tungsten, tungsten carbide, carbon, diamond, nickel, manganese, cobalt, silver, or copper; diamond, diamond like, and boron nitrides including cubic boron nitride applied by chemical vapor deposition or direct bonding to the surface; plated surfaces containing one or more of: diamond, diamond like, tungsten carbide, nickel carbide, or other abrasion resistant materials, or the like. In certain embodiments, the surface is treated with, coatings or surface treatments to increase hardness and/or toughness. One example of such a coating is nickel-tungsten carbide alloy, such as for example, Colmonoy 75 or Colmonoy 730, or the like. In addition, the gate and/or the upper and lower skirt may be made of materials or inserted materials known in the art to be useful for shearing hardened solid materials. Optionally, the gate and/or upper and lower skirt may be coated with material known in the art to be useful for shearing hardened solid materials.

The gate valve 59 may be hydraulically actuated, manually actuated, or controlled by any known means. In yet other embodiments, the gate valve 59 may be coupled to a control device for automated actuation. In certain embodiments, existing gate valves may be modified for use with the impactor injection systems described herein. In certain embodiments wherein the existing gate valve includes a chamfer on the leading edge of the gate, the chamfer may be removed and replaced with a honed and sharpened leading edge. Similarly, in certain embodiments, the edges of the upper and lower skirts 61, 63 can be honed and sharpened, particularly the interior edges of the upper and lower skirts 61, 63 which contact the gate 67.

In certain other embodiments, vent holes in the gate 67 may be replaced with slits, smaller holes or openings of other geometries, or the like, having a diameter which is less than the average diameter of the impactor particles. Preferably, the diameter is less than 50% of the diameter of the particles, more preferably less than 60% of the diameter of the particles. In certain embodiments, the slit or hole has a diameter less than 0.05 inches, more preferably having a diameter less than 0.04 inches. In certain embodiments, any recess between the gate 67 and skirt 61, 63 may be removed to provide a flush or near flush fit between the gate 67 and the upper and lower skirts 61, 63. In certain embodiments, the gap between the gate 67 and the upper and/or lower skirts 61, 63 is less than 10% of the particle diameter.

In an exemplary embodiment, a 5 inch gate valve produced by Worldwide Oilfield Machine, Inc. hereinafter WOM) was modified for use with a solid impactor direct injection system. The body of the WOM gate valve was honed to a 5 inch inner diameter and the gate was honed to remove the internal chamfer. A vent hole in the gate valve was plugged to prevent the accumulation of particles. The leading edges of the gate were honed to achieve a sharp cutting edge. The skirt, as received, included a roughly 0.020×45° chamfer on the cutting edge and was used as received. A wiper shield was installed, as shown in FIG. 5, at the leading edge of the gate. The wiper shield included an awning approximately 1.5 inches tall and 2 inches wide, extending about 0.5 inches outward from interior surface of the gate valve. A rubber strip was positioned at the bottom surface of the wiper shield, having an offset of approximately 0.035 inches behind the rubber strip.

The modified WOM gate valve was tested with a suspension of solid impactor having an average diameter of approximately 0.078 inches. The modified WOM valve was cycled approximately 3000 times with the impactor suspension and pressure tested every 300 cycles. The modified WOM valve showed no undue wear from the repeated cycling and the presence of the wiper largely shield prevented scoring or marking on the leading edge of the gate. The WOM valve was pressurized to at least 3000 psi each time it was pressure tested, and did not show any loss of pressure. Additionally, the modified WOM gate valve was closed on the impactor suspension multiple times, with very little discernible scoring or other damage to the surfaces of the gate valve.

In the initial five cycles of the above described test of the modified WOM valve, the wiper was not present and the leading edges of the gate were not protected with a wiper. During these cycles the leading edges of the gate were immediately damaged when the gate was closed on hardened impactors. This confirmed the effectiveness of the wiper in preventing damages to the moving components of the gate that are exposed to solid impactors, and in extending the life of the valve.

This application claims priority to and claims the benefit of co-pending U.S. Provisional Application Ser. No. 60/978,653, filed Oct. 9, 2007, the full disclosure of which is hereby incorporated by reference herein. This application is also related to U.S. provisional patent application Ser. No. 60/463,903, filed on Apr. 16, 2003; U.S. Pat. No. 6,386,300, issued on May 14, 2002, filed as application Ser. No. 09/665,586 on Sep. 19, 2000; U.S. Pat. No. 6,581,700, issued on Jun. 24, 2003, filed as application Ser. No. 10/097,038 on Mar. 12, 2002; pending application Ser. No. 11/204,981, filed on Aug. 16, 2005; pending application Ser. No. 11/204,436, filed on Aug. 16, 2005; pending application Ser. No. 11/204,862, filed on Aug. 16, 2005; pending application Ser. No. 11/205,006, filed on Aug. 16, 2005; pending application Ser. No. 11/204,772, filed on Aug. 16, 2005; pending application Ser. No. 11/204,442, filed on Aug. 16, 2005; pending application Ser. No. 10/825,338, filed on Apr. 15, 2004; pending application Ser. No. 10/558,181, filed on May 14, 2004; pending application Ser. No. 11/344,805, filed on Feb. 1, 2006; pending application Ser. No. 11/801,268, filed May 9, 2007; pending application No. 60/899,135, filed Feb. 2, 2007; pending application Ser. No. 11/773,355, filed Jul. 3, 2007; and pending application No. 60/959,207, filed Jul. 12, 2007 the disclosures of which are incorporated herein by reference in their entireties.

Disclosed herein is a wellbore excavation system that includes a drilling fluid source having a discharge in fluid communication with a drilling fluid line, an impactor feed that includes an impactor discharge, the impactor feed having impactors therein, an auger having an inlet connected to the impactor discharge, the auger having an exit in pressure communication with the drilling fluid line so that the impactors within the auger are at a pressure substantially equal with the drilling fluid line pressure, a mixture line in communication with the drilling fluid line and the auger exit, the mixture line having a mixture of drilling fluid and impactors therein, and a drill string extending into a wellbore, the drill string in communication with the mixture line and having a mixture of drilling fluid and impactors therein. The drilling fluid line and impactor discharge can be in pressure communication so the impactors proximate the impactor discharge are at a pressure substantially equal with the drilling fluid line pressure. The impactor supply and drilling fluid line may be in selective pressure communication. The impactor feed may have an upper impactor chamber selectively having impactors therein, a lower impactor chamber in fluid communication with the auger through the impactor discharge. The lower chamber can be in selective fluid communication with the upper impactor chamber so that the upper impactor chamber pressure is substantially equal to the lower impactor chamber. The lower impactor chamber has impactors therein. A valve may be included that is disposed between the upper and lower chambers. The valve may include a gate that can slide between an open and closed position. A cutting edge can be included in the valve so that when the gate is closed on an impactor, the impactor is sheared by the cutting edge and the gate can sealingly close. When opened, the valve allows impactors in the upper chamber to flow to the lower chamber, and when closed the valve isolates the upper chamber and lower chamber. The valve can further include a wiper sliding on the gate so that when the gate is either opened or closed impactors are cleaned from the gate. An equalizing line may be added to the system, the line having an end connected to the upper chamber and another end connected to the lower chamber, and a selectively openable and closable vent valve provided in the equalizing line. The system can further include a hopper having impactors, and a discharge on the hopper directed to the upper chamber. The hopper may include a feed auger.

The present disclosure can include a method of wellbore operations that includes injecting a mixture of drilling fluid and impactors. In one embodiment the method involves flowing pressurized drilling fluid through a drilling fluid line, feeding impactors from an impactor feed to an impactor motive device, mechanically urging impactors using the impactor motive device into an impactor supply line, injecting the impactors from the impactor supply line into the pressurized drilling fluid line to form a mixture of drilling fluid and impactors, the impactor motive device being in pressure communication with the drilling fluid line so that the pressure differential between the impactors in the impactor motive device and the drilling fluid line is significantly reduced to thereby correspondingly significantly reduce the motive force applied to inject the impactors into the drilling fluid line when forming the mixture, and directing the drilling fluid and impactor mixture to a flow line having an exit disposed in the wellbore so that the mixture is discharged from the exit into the wellbore to perform a wellbore operation. The method can include feeding the impactors in a batch process, this can involve directing a batch quantity of impactors to a batch feed section where the batch feed section is at a feed pressure that is lower than the drilling fluid line pressure, and the batch feed section comprising a portion of the impactor feed. The batch process can also include providing pressure communication between the batch feed section and the drilling fluid line pressure and directing the batch of impactors to the impactor motive device. The batch feed section can be sealed from the drilling fluid line pressure and vented to about the feed pressure and then the process repeated. The step of directing the batch of impactors to the impactor motive device may include providing the impactors from the batch feed section to a chamber and feeding the impactors from the chamber to the impactor motive device, and wherein the chamber is maintained in pressure communication with the impactor motive device so that the pressure differential between the chamber and impactor motive device is significantly reduced to correspondingly reduce resistance to impactor flow from the pressure differential. The impactor level in the chamber can be monitored and compared with a refill level. Based on the difference between the monitored level and the refill level, impactors can be provided from the batch feed section to the chamber. The wellbore operation can be one or more of excavating formation, forming a bore in a tubular in the wellbore, fracturing a formation, or chemically treating a formation.

Further disclosed herein is an impactor injector used for injecting impactors into a line carrying a drilling fluid stream. In this embodiment the injector comprises an impactor feed arrangement having an impactor exit, and an impactor conveyer having an inlet and a discharge. The inlet is in cooperation with the impactor feed arrangement exit and the discharge is mechanically coupled to the drilling fluid stream. The impactor conveyer is in pressure communication with the drilling fluid stream so that impactors in the impactor conveyer are at substantially the same pressure as the drilling fluid stream and so that pressure forces hindering injecting impactors into the drilling fluid stream are thereby correspondingly significantly reduced. The impactor feed arrangement has a lower chamber with impactors, the lower chamber is in pressure communication with the conveyer. The impactor feed arrangement may also have, an upper chamber with an impactor discharge directed to the lower chamber. The upper chamber is selectively in pressure communication with the drilling fluid stream and selectively has impactors stored therein. A valve may be disposed between the upper and lower chambers, the valve being selectively openable to discharge impactors from the upper chamber to the lower chamber. The upper chamber can be selectively depressurized to a feed pressure having a pressure less than the drilling fluid stream pressure. An impactor hopper can be included with the impactor injector, the hopper has an outlet directed to the upper chamber, and an impactor conveyer disposed in the hopper.

It is understood that variations may be made in the foregoing without departing from the scope of the disclosure. Any spatial references such as, for example, "upper," "lower," "above," "below," "radial," "axial," "between," "vertical," "horizontal," "angular," "upward," "downward," "side-to-side," "left-to-right," "right-to-left," "top-to-bottom," "bottom-to-top," "up to", etc., are for the purpose of illustration only and do not limit the specific orientation or location of the structure described above. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. For example, particulate matter other than impactors can be introduced into the drilling fluid line 24 from the impactor supply 26, such as cellulose, nut hulls, and the like. Accordingly, all such modifications, changes and/or substitutions are intended to be included within the scope of this disclosure as defined in the following claims.

The invention claimed is:

1. A wellbore excavation system comprising:

a drilling fluid source having a discharge in fluid communication with a drilling fluid line; an impactor feed that includes an impactor discharge, the impactor feed having impactors therein;

an auger having an inlet connected to the impactor discharge and an exit in pressure communication with the drilling fluid line so that the impactors within the auger are at a pressure substantially equal with the drilling fluid line pressure;

a mixture line in communication with the drilling fluid line and the auger exit, the mixture line having a mixture of drilling fluid and impactors therein; and a drill string extending into a wellbore, the drill string in communication with the mixture line and having a mixture of drilling fluid and impactors therein.

2. The wellbore excavation system of claim 1, wherein the drilling fluid line and impactor discharge are in pressure communication so that the impactors proximate the impactor discharge are at a pressure substantially equal with the drilling fluid line pressure.

3. The wellbore excavation system of claim 1, wherein the impactor supply and drilling fluid line are in selective pressure communication.

4. The wellbore excavation system of claim 1, wherein the impactor feed comprises:

an upper impactor chamber selectively having impactors therein;

a lower impactor chamber in fluid communication with the auger through the impactor discharge and in selective fluid communication with the upper impactor chamber so that the upper impactor chamber pressure is substantially equal to the lower impactor chamber pressure when in selective communication therewith, the lower impactor chamber having impactors therein.

5. The wellbore excavation system of claim 4, further comprising:

a valve disposed between the upper and lower chambers, a gate slidable in the valve between an open and closed position, a cutting edge in the valve so that when the gate is closed on an impactor the impactor is sheared by the cutting edge and the gate can sealingly close, the valve being selectively openable to allow impactors in the upper chamber to flow to the lower chamber and selectively closable to isolate the upper chamber and lower chamber.

6. The wellbore excavation system of claim 5, further comprising;

a valve disposed between the upper and lower chambers, wherein the gate valve has at least one wiper in the valve in sliding contact with the gate so that when the gate is either opened or closed impactors are cleaned from the gate.

7. The wellbore excavation system of claim 4, further comprising an equalizing line having an end connected to the upper chamber and another end connected to the lower chamber, and a selectively openable and closable vent valve provided in the equalizing line.

8. The wellbore excavation system of claim 4, wherein the impactor feed further comprises a hopper having a supply of impactors, and a discharge on the hopper directed to the upper chamber.

9. The wellbore excavation system of claim 8, further comprising a feed auger in the hopper discharge.

10. A method of conducting operations in a wellbore with drilling fluid mixed with impactors, the method comprising:

flowing pressurized drilling fluid through a drilling fluid line;

feeding impactors from an impactor feed to an impactor motive device and mechanically urging impactors using the impactor motive device into an impactor supply line;

injecting the impactors from the impactor supply line into the pressurized drilling fluid line to form a mixture of drilling fluid and impactors, the impactor motive device being in pressure communication with the drilling fluid line so that the pressure differential between the impactors in the impactor motive device and the drilling fluid line is significantly reduced to thereby correspondingly significantly reduce the motive force applied to inject the impactors into the drilling fluid line and to thereby form the mixture; and directing the drilling fluid and impactor mixture to a flow line having an exit disposed in the wellbore so that the mixture is discharged from the exit into the wellbore to perform a wellbore operation.

11. The method of claim 10, wherein the impactor motive device comprises an auger.

12. The method of claim 10 further comprising:

(a) directing a batch quantity of impactors to a batch feed section, the batch feed section being at a feed pressure that is lower than the drilling fluid line pressure, and the batch feed section comprising a portion of the impactor feed, (b) providing pressure communication between the batch feed section and the drilling fluid line pressure, and (c) directing the batch of impactors to the impactor motive device.

13. The method of claim 12, further comprising:

(a) sealing the batch feed section from the drilling fluid line pressure, (b) venting the batch feed section to about the feed pressure, and (c) repeating steps (a)-(c) of claim 12.

14. The method of claim 12, wherein the step of directing the batch of impactors to the impactor motive device includes providing the impactors from the batch feed section to a chamber and feeding the impactors from the chamber to the impactor motive device, and wherein the chamber is maintained in pressure communication with the impactor motive device so that the pressure differential between the chamber and impactor motive device is significantly reduced to correspondingly reduce resistance to impactor flow from the pressure differential.

15. The method of claim 14, further comprising monitoring the impactor level in the chamber, comparing the monitored impactor level with a refill level, and providing impactors from the batch feed section to the chamber based on the difference in the refill level and the monitored level.

16. The method of claim 10, wherein the wellbore operation is selected from a list consisting of excavating formation, forming a bore in a tubular in the wellbore, fracturing a formation, and chemically treating a formation.

17. An impactor injector for injecting impactors into a line carrying a drilling fluid stream, the injector comprising:

an impactor feed arrangement having an impactor exit; and an impactor conveyer having an inlet and a discharge, the inlet in cooperation with the impactor feed arrangement exit and the discharge mechanically coupled to the drilling fluid stream, the impactor conveyer being in pressure communication with the drilling fluid stream so that impactors in the impactor conveyer are at substantially the same pressure as the drilling fluid stream and so that pressure forces hindering injecting impactors into the drilling fluid stream are thereby correspondingly significantly reduced.

18. The impactor injector of claim 17, wherein the impactor feed arrangement comprises a lower chamber having impactors therein and in pressure communication with the conveyer and an upper chamber, the upper chamber having an impactor discharge directed to the lower chamber.

19. The impactor injector of claim 18, wherein the upper chamber is selectively in pressure communication with the drilling fluid stream.

20. The impactor injector of claim 18, wherein the upper chamber selectively has impactors stored therein.

21. The impactor injector of claim 20, further comprising a valve disposed between the upper and lower chambers, the valve being selectively openable to discharge impactors from the upper chamber to the lower chamber.

22. The impactor injector of claim 21, wherein the upper chamber is selectively depressurized to a feed pressure having a pressure less than the drilling fluid stream pressure.

23. The impactor injector of claim 21, further comprising an impactor hopper having an outlet directed to the upper chamber, and an impactor conveyer disposed in the hopper.

* * * * *